US006056495A

United States Patent [19]

Doyle et al.

[11] Patent Number: 6,056,495

[45] Date of Patent: May 2, 2000

[54] SPIRAL COIL INSERTION APPARATUS AND METHOD

[76] Inventors: Thomas J. Doyle, 200 Captains Ct., Winneconne, Wis. 54986; Gerald E. Blaha, 1413 Meadowbreeze Cir., Neenah, Wis. 54952

[21] Appl. No.: 09/050,613

[22] Filed: Mar. 30, 1998

[51] Int. Cl.[7] ..... B42B 5/10; B42B 5/12

[52] U.S. Cl. ..... 412/39; 412/38

[58] Field of Search ..... 412/38, 39

[56] References Cited

U.S. PATENT DOCUMENTS 2,532,443 12/1950 Freundlich .
2,638,609 5/1953 Penner .
2,961,012 11/1960 Freundlich .
2,963,049 12/1960 Biel et al. .
3,592,242 7/1971 Sickinger .
4,232,858 11/1980 Fabrig ..... 412/39
5,584,632 12/1996 Stiles et al. .
5,695,308 12/1997 Hastings et al. ..... 412/38

*Primary Examiner*—Willmon Fridie, Jr.
*Assistant Examiner*—Mark T. Henderson
*Attorney, Agent, or Firm*—Andrus, Sceales, Starke & Sawall

[57] ABSTRACT

An automatic spiral binding apparatus for edge binding a book of sheets with a spiral coil includes a book supporting table that is indexable between loading, coil insertion, coil crimping and book discharge stations. The apparatus can accommodate a wide range of book thicknesses, coil diameters and coil pitches. Positioning hooks in the loading station are selected to correspond to the coil diameter and are mounted at an incline to match the coil pitch in a manner which pre-orients the book edge to both the proper curvature and proper pitch to facilitate subsequent threading of the spiral coil into the holes in the edge of the book at the following insertion station.

16 Claims, 12 Drawing Sheets

FIG. 2
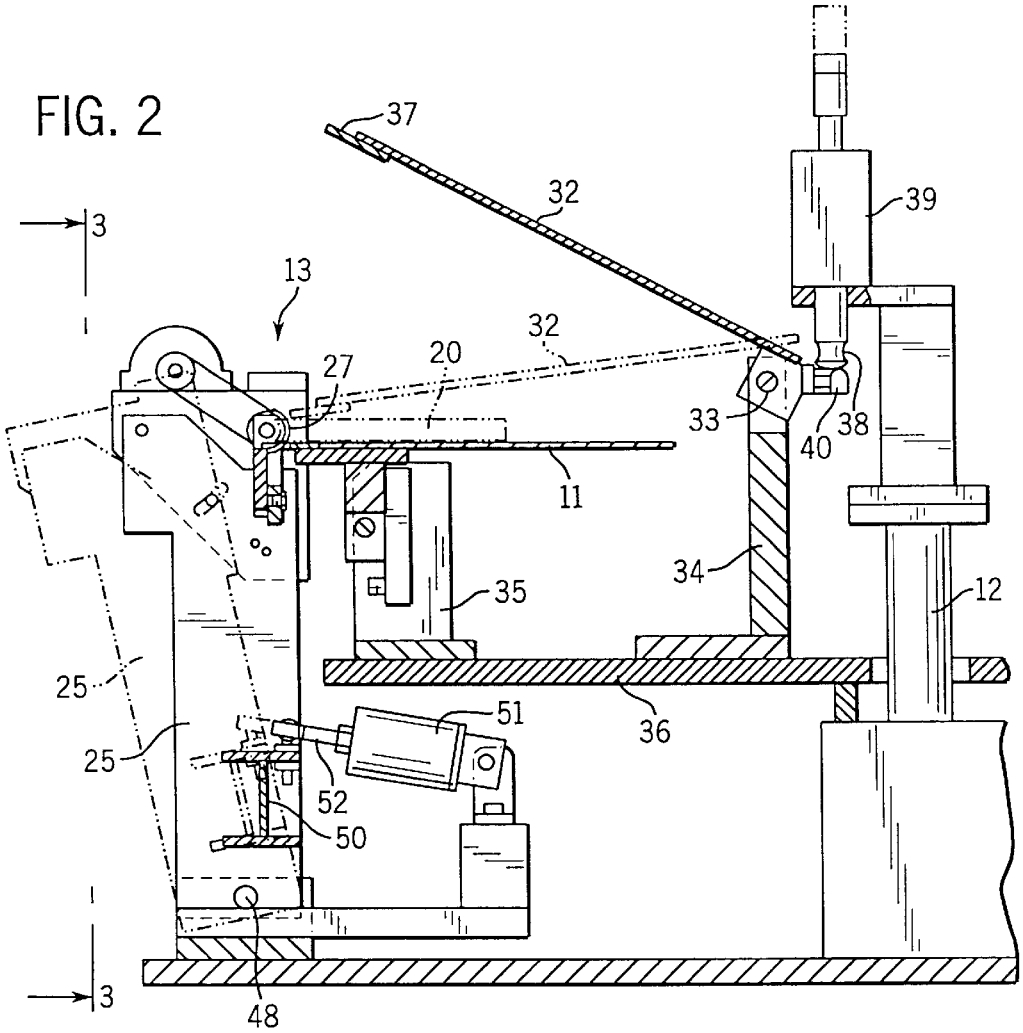
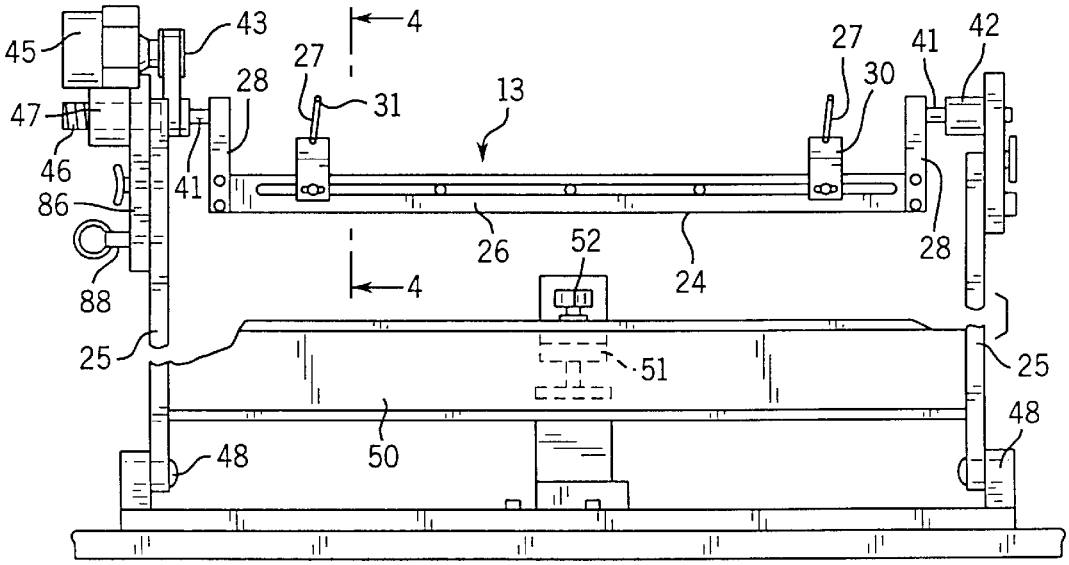
FIG. 3

SPIRAL COIL INSERTION APPARATUS AND METHOD

BACKGROUND OF THE INVENTION

The present invention pertains to an apparatus and related method for edge-binding a book of sheets using a spiral binding coil.

Spiral binding coils have long been used to provide the edge bindings for books of paper sheets. Spiral coils may be metal or plastic. Books of sheets to be bound are pre-punched with a series of equally spaced through holes along one edge of the book, and a spiral coil is typically inserted by rotating the coil on its axis and threading the same on a spiral path sequentially through the holes along the edge of the book. Spiral binding apparatus and methods have typically been fairly labor intensive and attempts to automate the binding process have been difficult due to wide variations in coil diameters, book thicknesses, coil materials and the like.

SUMMARY OF THE INVENTION

In accordance with the present invention, a spiral binding coil insertion device utilizes four station indexing which allows the book to be loaded and pre-positioned in a first station, indexed to an insertion station where the coil is inserted, further indexed to a trim station for coil cutting and crimping, and finally indexed to a discharge station. A four station book indexing arrangement permits four books to be processed simultaneously.

The load station includes a generally horizontal book support, and a pair of semicircular hooks which are adapted to be received in a spaced pair of the through holes in the edge of the book to provide an initial semicircular and pitched orientation for the series of holes. Means are also provided for withdrawing the hooks. The means for withdrawing the hooks in the load station includes a rotatable pivot arm which mounts the hooks for rotational movement on an axis generally coincident with the semicircular orientation of the holes in the edge of the book. Means are provided for simultaneously rotating the pivot arm on the axis and for moving the arm axially such that the hooks are withdrawn from the holes on a path substantially coincident with the semicircular and pitched orientation. The hooks are shaped to define a circle having a diameter approximately equal to the diameter of the coil and are mounted to lie in a plane disposed generally on the pitch angle of the coil. The rotatable pivot arm assembly includes a hook mounting bar which extends parallel to and radially offset from the rotational axis, and a pair of crank arms each of which is attached at one end to an end of the mounting bar and has an opposite end journaled for rotational and axial movement on said axis. The means for rotating and axially moving the arm includes a lead screw for the journaled end of one of the crank arms.

Means are also provided for releasably holding the book on the book support in its initial orientation. The holding means includes a pivotable holddown plate which is adapted to rest on the upper face of the book in the load station and the insertion station. The book support and book are indexed to a coil insertion station and a spiral coil is rotatably fed along a mandrel positioned adjacent one end of the book edge and aligned generally axially with the semicircular orientation of the through holes. The lead end of the axially fed coil is caused to pass sequentially upwardly into and through the holes and along the edge of the book. The book support includes a toothed edge which underlies the edge of the book with adjacent teeth defining spaces aligned with the holes in the book edge. The edges of the teeth which define the spaces are provided with lead-in champfers to facilitate entry of the lead end of the coil during insertion.

The apparatus also includes a trim station which has a cutting and crimping tool for each of the lead and trailing ends of the coil, and means for moving the tools into operative engagement with the coil ends. The apparatus also includes a discharge station having means for pivoting the book support on a generally horizontal axis to discharge the book by gravity. The book supports are mounted to rotate on a vertical axis consecutively between the load, insertion, trim and discharge stations. The pivotable holddown plate is adapted to rest on the upper face of the book in each of the four stations.

The apparatus of the present invention operates in accordance with a method including the steps of: supporting the book horizontally on a support; aligning the edge of the book to provide a semicircular concave shape with a diameter corresponding approximately to the coil diameter and to incline the holes in a direction along the edge at an acute angle approximately equal to the pitch angle of the coil; holding the alignment of the edge; and, feeding the coil rotationally along its axis to cause the lead end of the coil to sequentially pass upwardly into and through the holes and along the edge. The aligning step preferably comprises placing the book on a pair of spaced semicircular hooks which are positioned on a common axis, and positioning the hooks to lie approximately at said pitch angle. The method also includes, during the holding step, the step of withdrawing the hooks from the holes. Withdrawing the hooks is accomplished by rotating said hooks generally on their common axis.

BRIEF DESCRIPTION OF THE DRAWINGS

FIG. 2 is an enlarged side elevation, partly in section, showing details of the book loading station.

FIG. 3 is a front elevation view taken on line 3—3 of FIG. 2.

DETAILED DESCRIPTION OF THE PREFERRED EMBODIMENT

Figure 1:
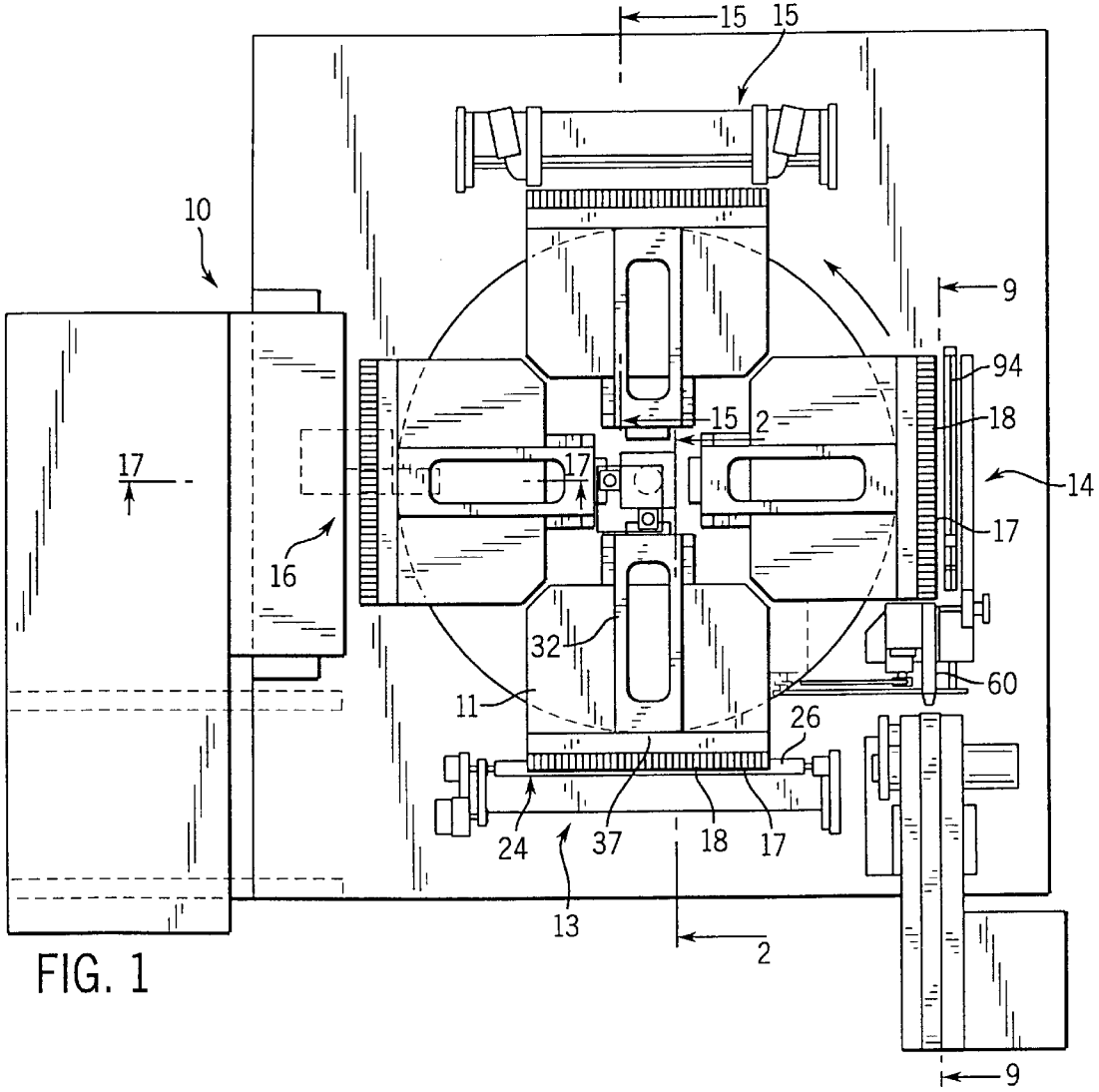
FIG. 1 is a top plan view of the apparatus of the present invention.

As shown generally in the top plan view of FIG. 1, the coil inserting machine 10 of the present invention includes four identical horizontal book support plates 11 mounted 90° apart and disposed to rotate together around the vertical axis of a central mounting post 12. Each of the support plates 11 is sequentially indexed through 90° of rotation to carry a book between a load station 13, a coil insertion station 14, a trim station 15, and a discharge station 16.

Each of the book support plates 11 has a front edge 17 in the form of a replaceable comb 18. A book 20 to be bound has one edge 21 which is provided with a series of equally spaced through holes 22 closely spaced from and on a line parallel to the edge 21. The holes may be round, square, or other shape as is well known in the art. When the book 20 is positioned on the support plate 11, the teeth 23 of the comb 18 on the front edge of the support plate extend between the holes 22 in the edge of the book. In the load station 13, the front edge 17 of the book support plate extends into a space defined by a rotatable pivot arm 24 which is supported between two vertical pivot arm frame members 25. The pivot arm 24 includes a generally horizontal mounting bar 26 on which a pair of laterally adjustable semicircular hooks 27 are mounted. In use, the hooks 27 are typically positioned near opposite ends of the book edge 21. Each end of the mounting bar 26 is supported by a short crank arm 28, the opposite end of each of which is rotatably attached to the upper end of one of the frame members 25. The semicircular hooks 27 are aligned on the mounting bar 26 such that the axis through their circular centers coincides with the pivot axis of the pivot arm 24.

Figure 4:
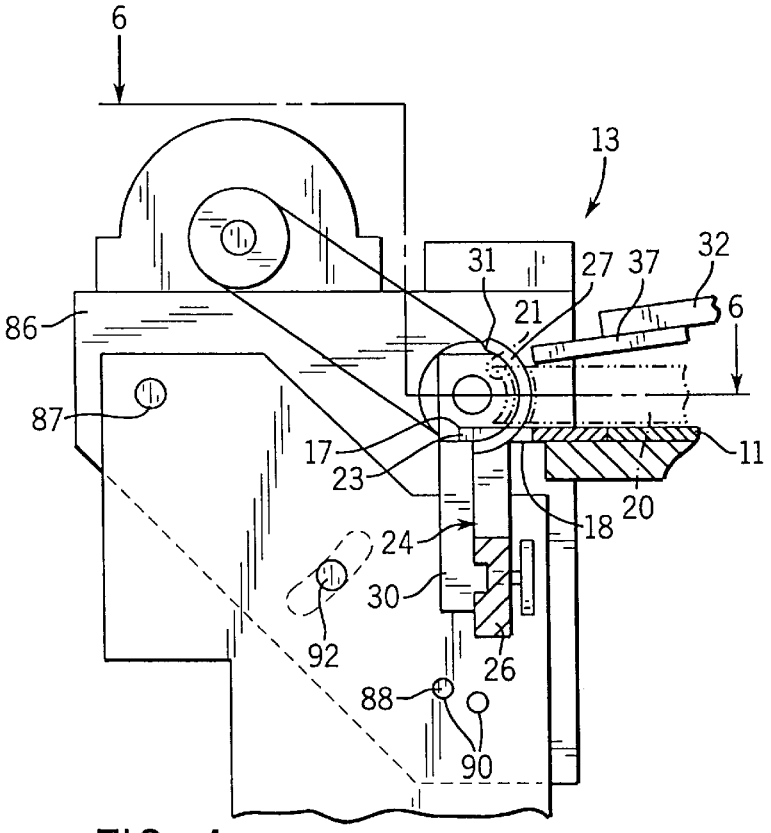
FIG. 4 is a vertical sectional detail taken on line 4—4 of FIG. 3.
Figure 5:
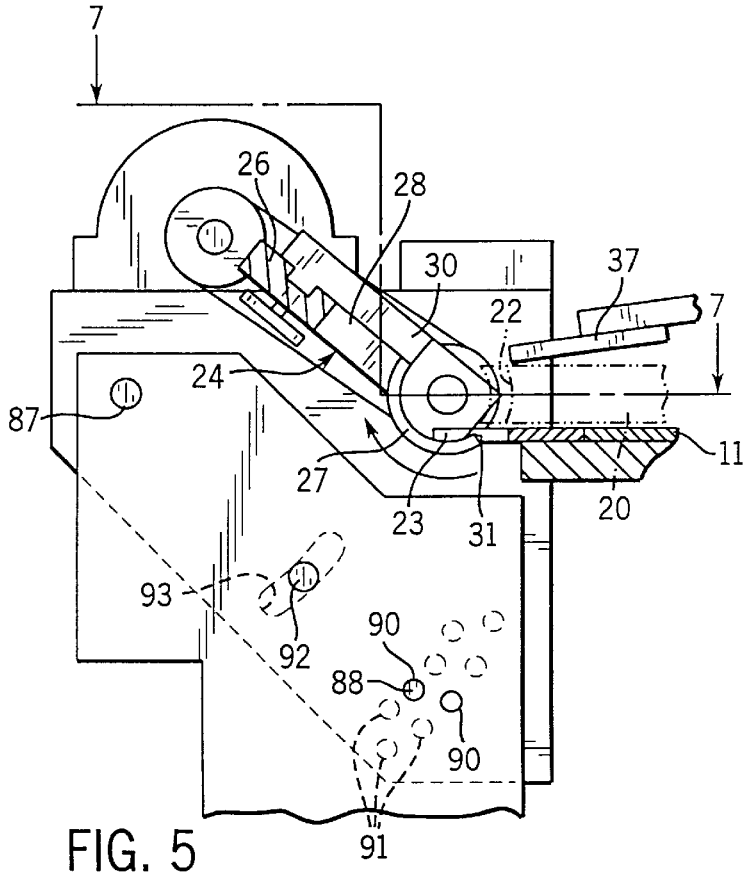
FIG. 5 is a sectional detail similar to FIG. 4 showing the hook pivot arm rotated to another position.

Referring particularly to the details of FIGS. 4 and 5, with the pivot arm 24 hanging downwardly in the load position, the hooks 27 are positioned adjacent and just above the front edge 17 of the book support plate 11. The intermediate hook arms 30 which interconnect the lower ends of the hooks and the hook mounting bar 26 are positioned just below the comb 18 at the edge of the support plate such that the hooks extend between pairs of comb teeth 23. The free upper ends 31 of the hooks 27 lie above the support plate and point radially outwardly from the center of the machine 10.

To load a book 20 on the machine, an operator standing in front of the load station 13 orients the edge 21 of the book down and extending horizontally, generally centered along the pivot arm 24 and causes the ends 31 of the hooks to enter the through holes 22, preferably somewhere near opposite ends of the book edge 21. With a generally rearward and downward rotational movement of the book 20 on the hooks 27, the hooks are caused to pass into and through the holes 22 until the book is supported horizontally on the support plate 11, as best seen in FIG. 4.

As may best be seen in FIG. 3, the semicircular hooks 27 are attached to their respective arms 30 in a slightly angled orientation with respect to the vertical. The angle at which the hooks are disposed is selected to approximate the pitch angle of the spiral binding coil to be inserted into the holes 22, as will be described in detail below. Furthermore, as indicated above, the diameter of the semicircular hooks 27 is selected to approximate the diameter of the spiral coil as well. When the book 20 is mounted on the hooks and pivoted to lie flat on the horizontal support plate 11, the hooks will have forced the pages in the book to assume a shape in which the book edge has a concave shape corresponding generally to the semicircular shape of the hooks, and the through holes 22 take a lateral slant corresponding to the angled orientation of the hooks 27 (and corresponding generally to the pitch angle of the spiral coil to be subsequently inserted).

A holddown plate 32 is attached by a horizontal pivot joint 33 to a vertical holddown plate support 34 near the central mounting post 12. The vertical holddown plate support 34 and a vertical stand 35 for the support plate 11 (to the upper end of which the book support plate 11 is attached) are both supported on a rotatable platform 36 which is mounted for rotation on the central mounting post 12. The holddown plate 32 includes a forward edge plate 37 which is pivoted downwardly into engagement with the top of the book 20 just rearwardly of the line of holes 22. Prior to loading the book on the hooks 27, the holddown plate 32 is held in an upwardly pivoted position, best shown in FIG. 2, by the extended rod end 38 of an air cylinder 39 bearing against a pivot contact surface 40 offset slightly from the horizontal pivot joint 33. Release of pressure on the air cylinder 39 retracts the rod end 38 and allows the forward edge 37 of the holddown plate to pivot down into holding contact with the book.

Figure 6:
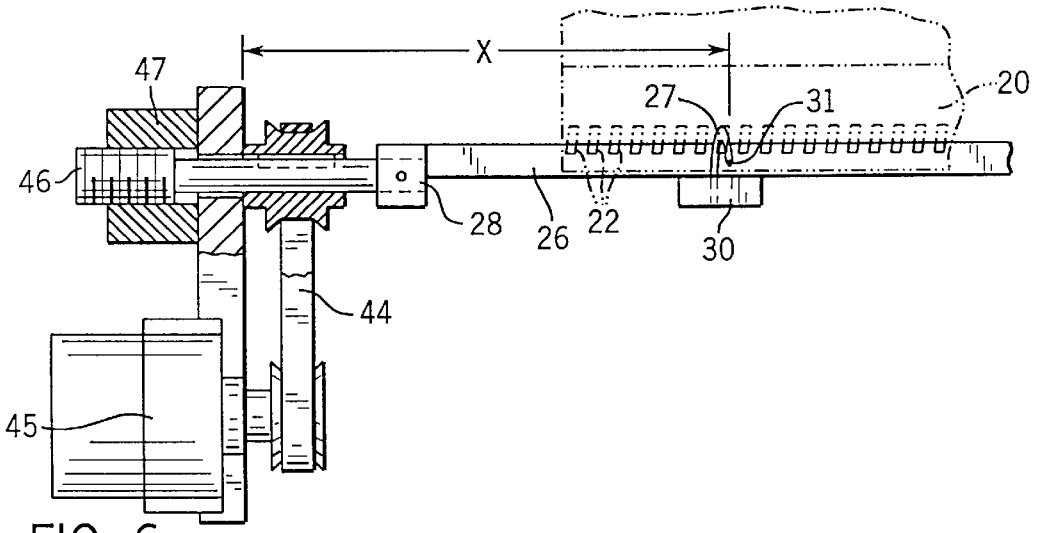
FIG. 6 is a sectional detail taken on line 6—6 of FIG. 4.
Figure 7:
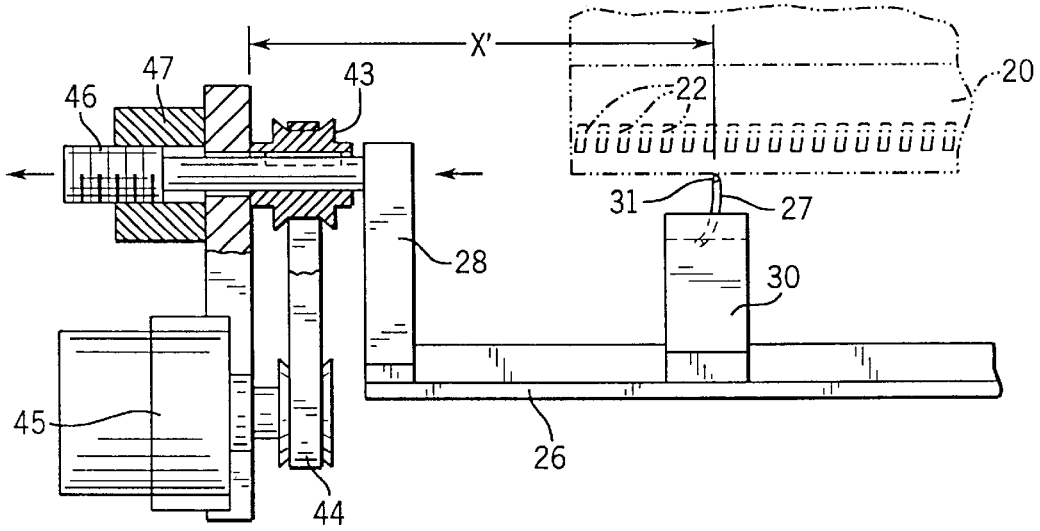
FIG. 7 is a sectional detail taken on line 7—7 of FIG. 5.

Referring also to FIGS. 6 and 7, to permit the platform 36 to be rotated in order to index the support plate 11, book 20 and holddown plate 32 from the load station 13 to the following insertion station 14, the hooks 27 must first be withdrawn from the book 20. Each of the crank arms 28 of the pivot arm 24 includes a stub shaft journaled in a sleeve bearing 42 at the upper end of the vertical pivot arm frame member 25. One of the stub shafts 41 has a driven pulley 43 keyed to or splined thereon and which is driven, via drive belt 44, by a low speed rotary actuator 45. The outer end of the driven stub shaft 41 is provided with a lead screw 46 carried in a cooperating screw nut 47 attached to the vertical frame member 25. Operation of the rotary actuator 45 causes the pivot arm to rotate and, because the semicircular hooks 27 are positioned to coincide with the rotational axis of the arm defined by the stub shafts 41, the hooks 27 will rotate out of the holes 22 in the book edge. Furthermore, the pitch of the lead screw 46 is selected to approximate the pitch of the spiral coil and the pitch angle at which the hooks are mounted, such that rotation of the pivot arm causes the hooks to follow a spiral path as they are withdrawn. In this manner, neither the concave recess formed in the edge 21 of the book nor the pitched angle of the through holes 22, both of which are created when the book is loaded on the hooks, is disturbed. The weight of the forward edge plate 37 of the holddown plate 32 on the book near the edge holds this orientation as the support plate 11 and book are rotationally indexed from the load station 13 to the insertion station 14.

However, before the book is indexed, ,the entire load station apparatus 13 is tilted away from the support plate 11 to provide clearance for indexing rotation. The lower ends of the main pivot arm frame members 25 are supported on a load tilt pivot 48 and are interconnected by a cross member 50 just above the pivot 48. A linear tilt actuator 51, secured to the main frame, has its rod end 52 attached to the cross member 50 to effect the tilting movement of the load station.

Details of the coil insertion station 14 are shown in FIGS. 9–14. After the book support plate 11, book 20 and holddown plate 32 have been indexed into the insertion station 14, a spiral coil drive mechanism 53 is indexed upwardly from a lower inoperative position (shown in FIG. 11) to its operative position shown in FIG. 10. The coil drive mechanism 53 includes a supporting frame 54 mounted to be moved vertically up and down by a vertical linear actuator 55.

Conventional spiral coils 56, made for example of a suitable thermoplastic material, are supplied serially to the insertion station 14 by a narrow belt conveyor 57. With a book 20 supported on the support plate 11 and held with the through holes positioned in the semicircular and pitched orientation created in the load station 13. A spiral coil 56 is fed by the belt conveyor 57 onto the tapered end 58 of a stationary arbor 60. At a point approximately half the axial length of the arbor 60, the lead end 61 of the coil is captured in the nip 62 formed by the arbor 60 and the surface of a rotating rubber drive wheel 63. From the nip 62 to the downstream end of the arbor 60, the arbor is provided with a series of equally spaced guide pins 64 which are secured at their upper ends to the arbor and extend radially from the arbor in a vertical downward direction. The guide pins are spaced along the axis of the arbor to match the pitch of the through holes 22 in the edge of the book to be bound. As the lead end 61 of the coil is captured in the drive wheel nip 62, the coil 56 is turned on its axis and begins to thread one convolution at a time between the guide pins 64. The guide pins 64 serve to separate the individual convolutions of the coil and to orient them at the proper pitch for insertion in the through holes in the book. The drive wheel 63 is driven by a small drive motor 65 via drive belt 66.

Figure 11:
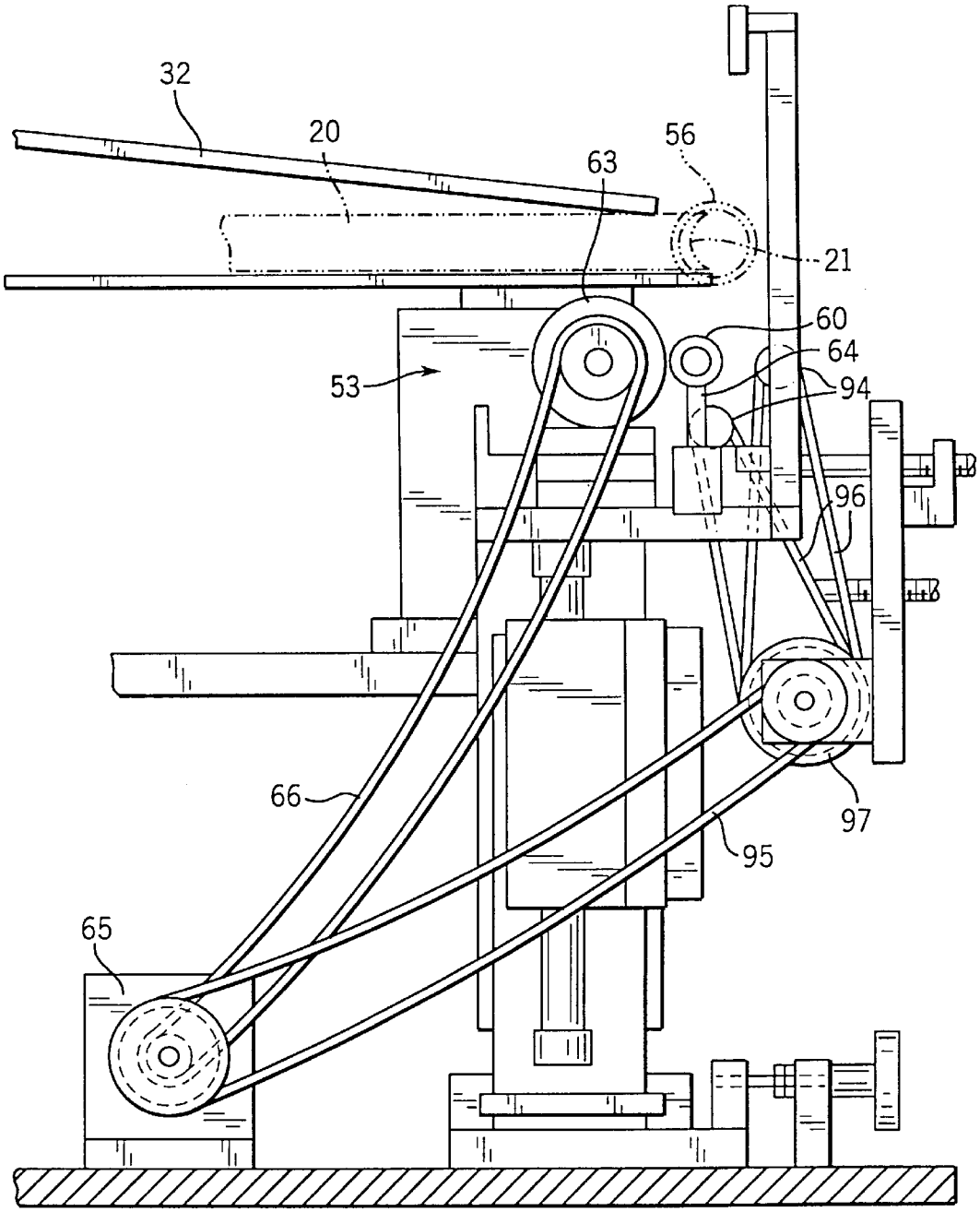
FIG. 11 is a view similar to FIG. 10 showing the coil insertion device repositioned downwardly to an inoperative position for book indexing.
Figure 12:
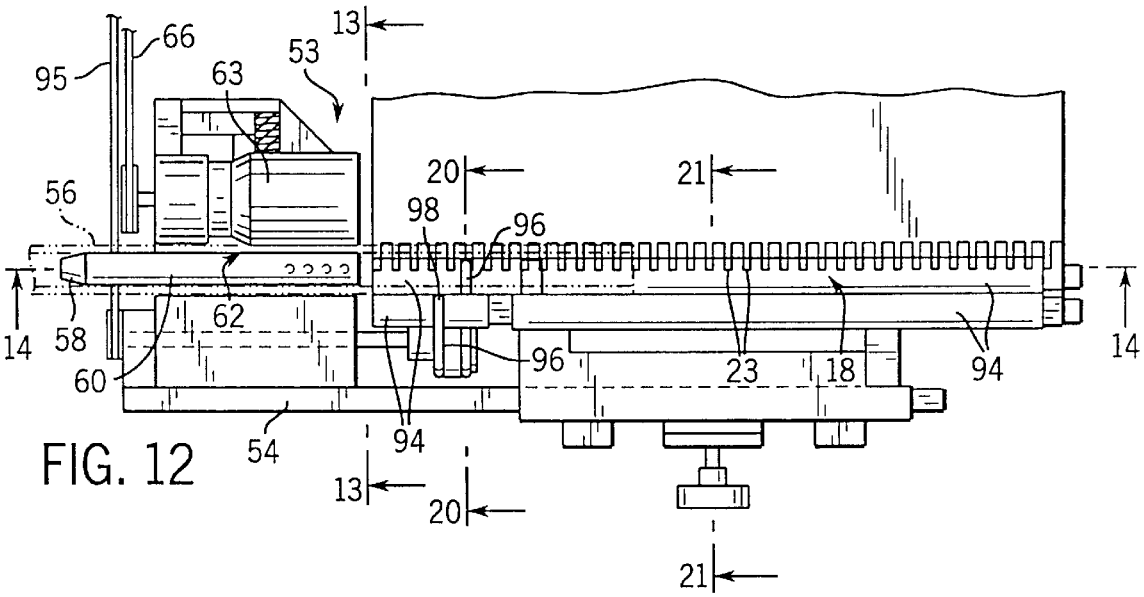
FIG. 12 is a horizontal sectional detail taken on line 12—12 of FIG. 9.
Figure 13:
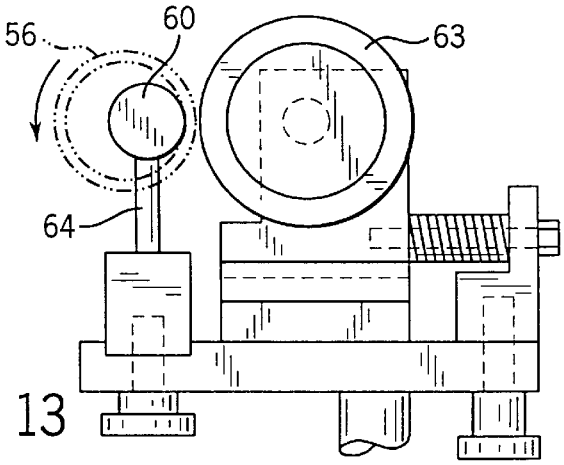
FIG. 13 is a vertical section taken on line 13—13 of FIG. 12.
Figure 14:
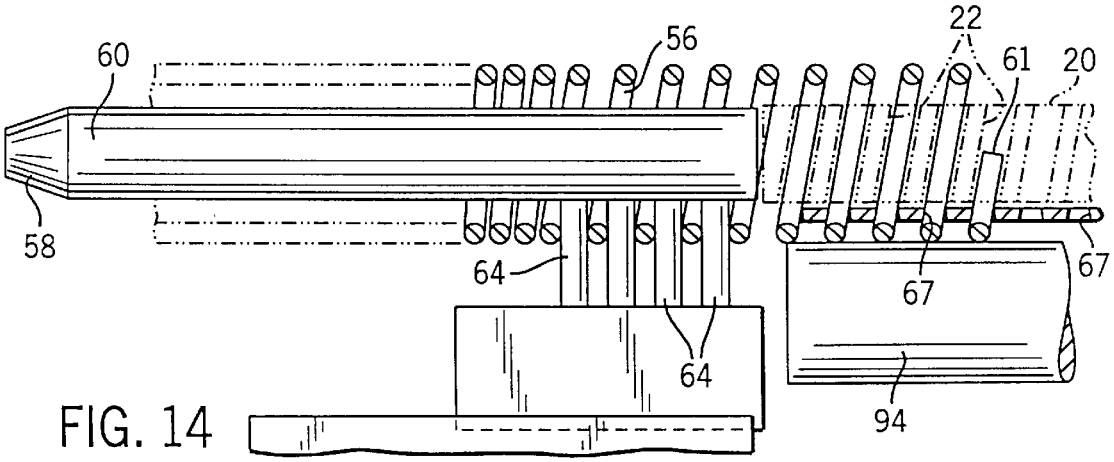
FIG. 14 is an enlarged elevational detail of a portion of the coil inserting device.

As the lead end 61 of the coil 56 leaves the downstream end of the arbor 60, it enters the first of the through holes 22 in the edge of the book as may best be seen in FIG. 14. As previously indicated, the spaced guide pins 64 serve to orient the rotating coil 56 at the proper pitch to match the pattern of through holes in the edge of the book. In addition, the teeth 23 in the comb 18 at the front edge of the support plate are oriented beneath and between the holes, and are provided with champfers 67 to facilitate movement of the lead end 61 upwardly between adjacent teeth and into the hole 22. Furthermore, the holes 22 have been pre-positioned in the load station 13 to establish the semicircular and pitched orientation to match the spiral coil 56. The coil is precut to match the length of the book edge and when the last convolution of the coil leaves the end of the arbor 60 and is released from driving contact with the drive wheel 63, the lead end 61 has passed upwardly through the last through hole 22 at the opposite downstream end of the book edge 17. Release of the last convolution of the coil 56 from the drive wheel nip 62 is sensed to stop the drive motor 65 and to cause the vertical linear actuator 55 to move the coil drive 53 downwardly, as shown in FIG. 11. This clears all obstructions to rotational indexing of the book support plate 11, book 20, and holddown plate 32 which then rotate together from the insertion station 14 to the trim station 15.

The upward rotational path of the lead end 61 of the coil 56 as it passes through the holes 22 in the edge of the book permits, if necessary, the lead end to move a misaligned page or pages slightly upwardly against the relatively light load provided by the holddown arm edge plate 37. As a part of the book lifts in response to being engaged by the lead end of the coil, the book tends to realign itself and allow passage of the coil.

Figure 20:
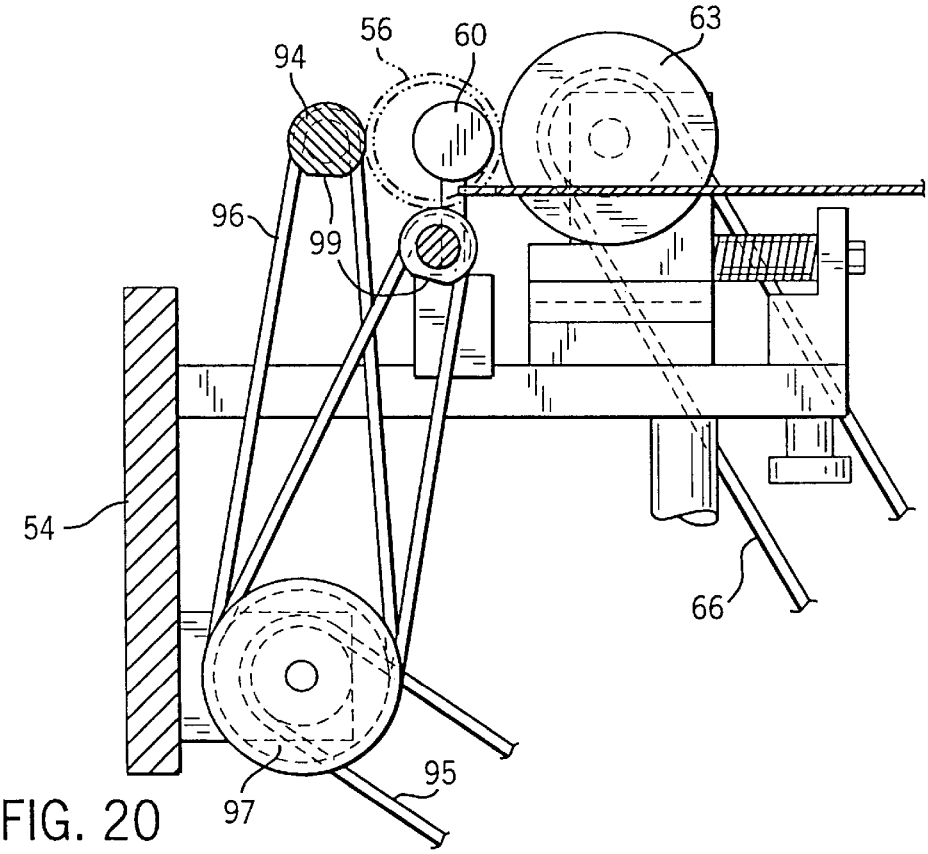
FIG. 20 is a sectional detail taken on line 20—20 of FIG. 12.
Figure 21:
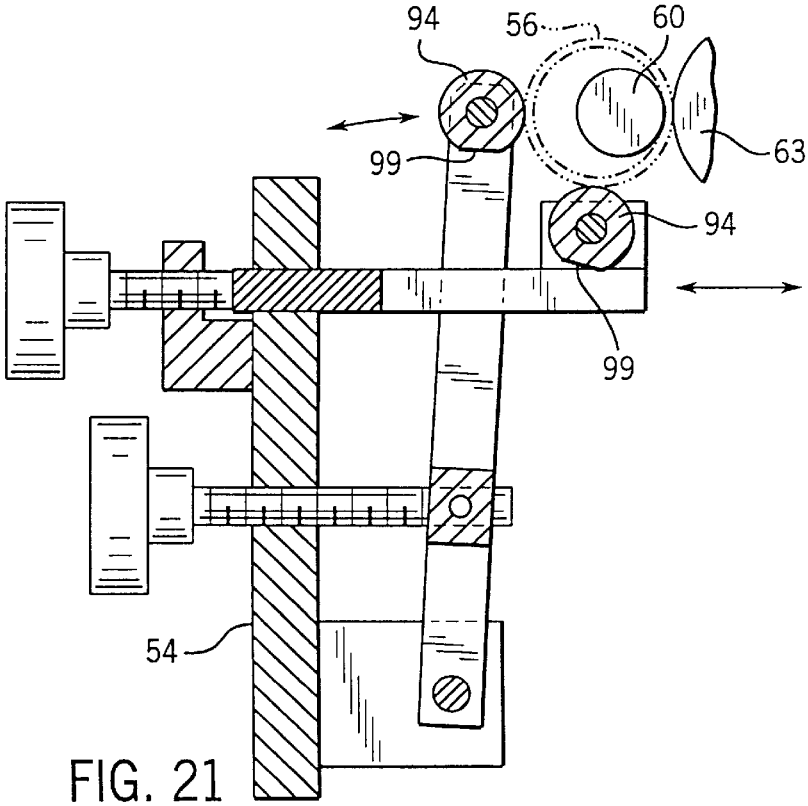
FIG. 21 is a sectional detail taken on line 21—21 of FIG. 12.

It is been found that certain plastic coils 56, depending on the coil diameter and the gauge of the material, may distort somewhat and expand in diameter during the coil insertion process, as a result of frictional drag of the coil convolutions contacting the surfaces of the holes in the book edge. If too much diametral expansion of the coil is permitted, the coil will bind in the holes 22 and may eventually overcome the drive force and become locked in place. Referring also to FIGS. 20 and 21, to prevent such coil distortion, a pair of driven guide rollers 94 are positioned, respectively, below and to one side of the coil and in parallel relation to the edge of the book 20. Each of the rollers is driven in the same direction and at the same peripheral speed as the coil drive wheel 63. A drive belt arrangement, including a main drive belt 95, extending from the main drive motor 65, driving a pair of shorter roller drive belts 96 through a common transfer pulley 97, rotate the drive rollers 94 so that the drive roller surfaces move in the same direction as the adjacent coil convolutions. Each of the guide rollers 94 is provided with a suitable peripheral groove 98 to receive a roller drive belt 96. However, the guide rollers 94 are positioned to normally maintain the roller surfaces out of contact with the coil as it is being rotatably inserted into the holes in the book edge. Close spacing is maintained, however, between the surfaces of the guide rollers 94 and the coil such that, if there is any significant expansion in the diameter of the coil, the coil convolutions will come into contact with the guide rollers thereby halting any further expansion in the coil diameter. Each of the guide rollers 94 is adjustably mounted on the supporting frame 54 so that the roller position may be adjusted to accommodate varying coil diameters. Preferably, the rollers 94 are provided with narrow flats 99 on their outer surfaces that extend the full axial lengths of the rollers. The flats provide brief interruption of roller contact with the coil convolutions should the coil diameter expand into contact. This interruption prevents the rotating guide rollers 94 from disrupting the axial feed of the coil 56.

Figure 15:
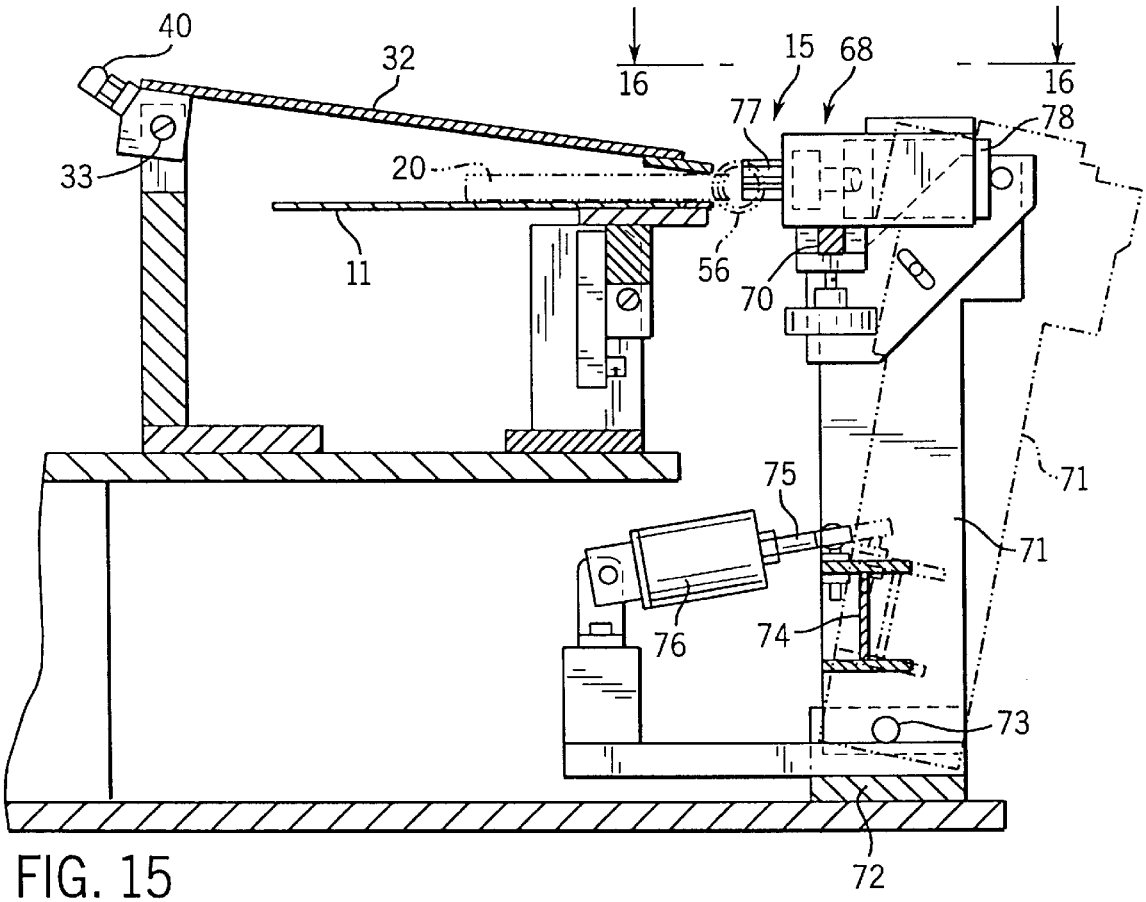
FIG. 15 is an enlarged vertical sectional view through the trim station taken on line 15—15 of FIG. 1.
Figure 16:
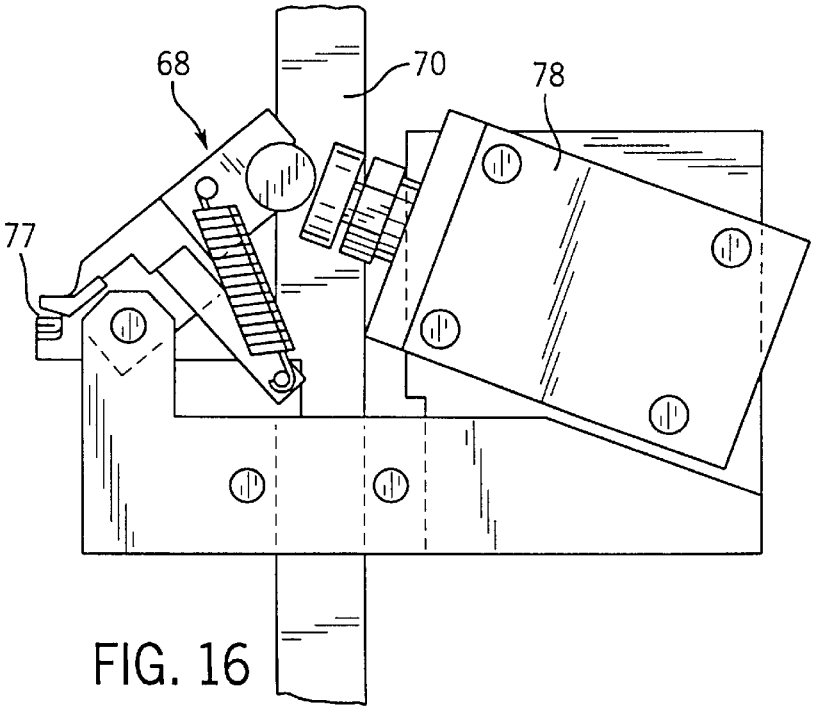
FIG. 16 is a top plan detail taken on line 16—16 of FIG. 15.

Referring to FIGS. 15 and 16, a pair of trim heads 68 are mounted for lateral sliding adjustment on a slide bar 70 which extends parallel to and spaced outwardly from the bound edge of the book 20 supported on the support plate 11. The trim heads 68 are moved to and locked in positions corresponding to the opposite ends of the spiral coil 56. The convolutions of the coil remain positioned between the teeth on the comb 18 of the support plate 11 and serve to maintain the position of the bound book edge as it is indexed from the insertion station to the trim station. In this manner, the trim heads will be enabled to accurately engage the coil ends. The trim heads slide bar 70 extends between a pair of vertical frame members 71 which are connected at their lower ends by a trim tilt pivot 73 to the machine base 72. The vertical frame members 71 are interconnected with a cross member 74 to which the rod end 75 of a linear actuator 76 is attached. As described previously with respect to the load station 13, the trim station linear actuator 76 operates to tilt the entire trim station 15 on the pivot 73 to remove any obstruction to rotational indexing of the support plate and book.

Figure 19:
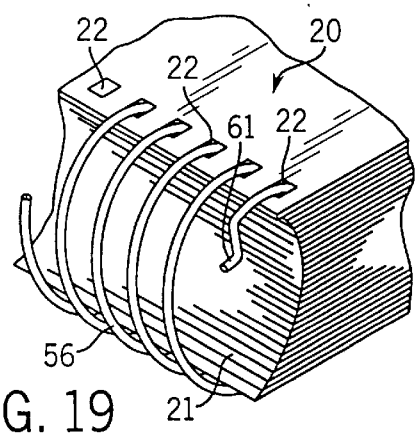
FIG. 19 is a detailed perspective view of one end of the edge of a book bound with a spiral coil in accordance with the present invention.
Figure 8:
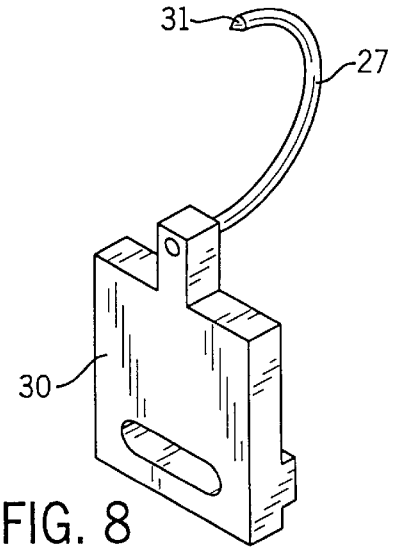
FIG. 8 is an enlarged perspective view of a semicircular book positioning hook.
Figure 9:
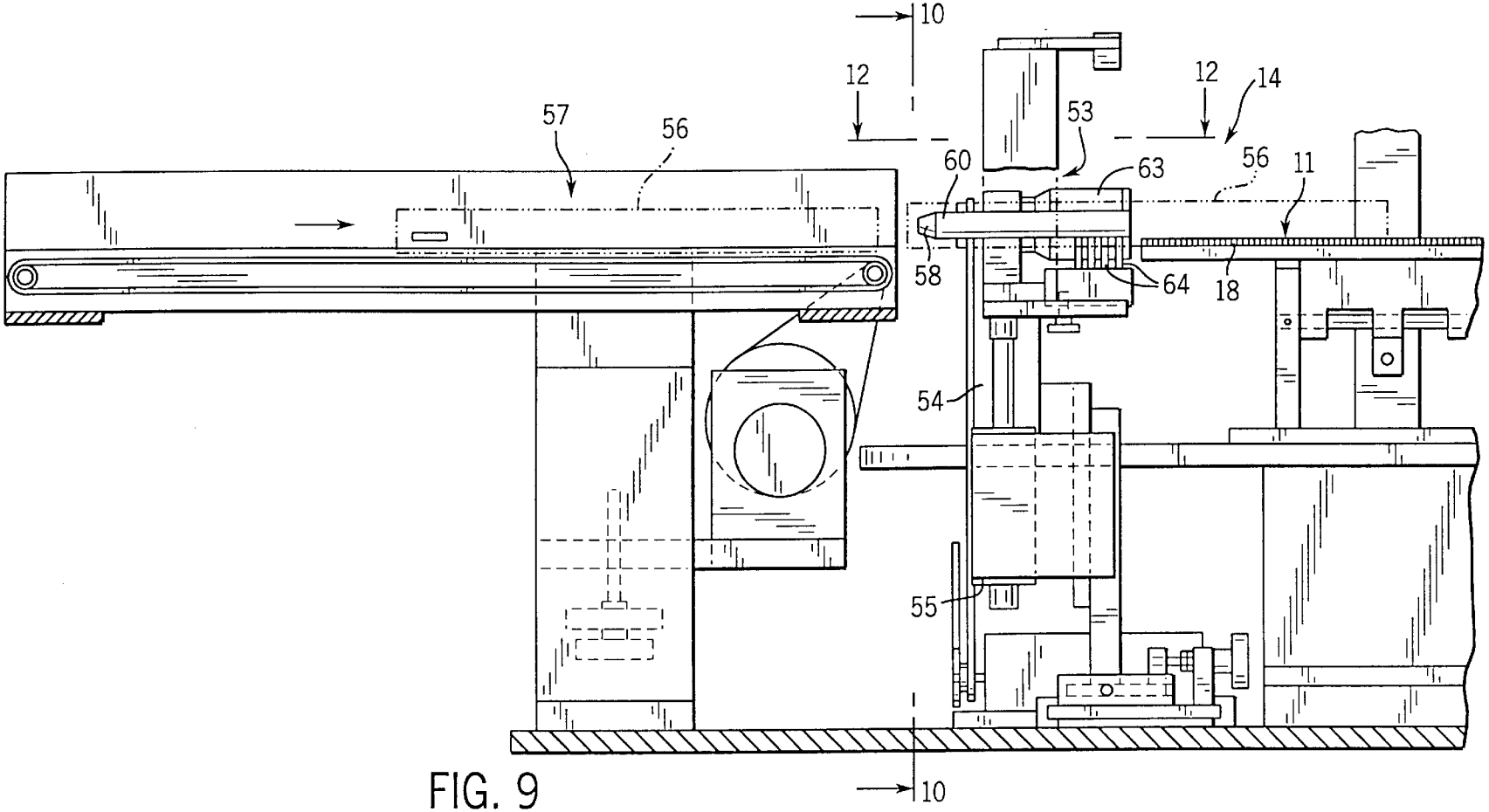
FIG. 9 is a front elevation view of the coil insertion station of the present invention, additionally showing the coil in feed conveyor.
Figure 10:
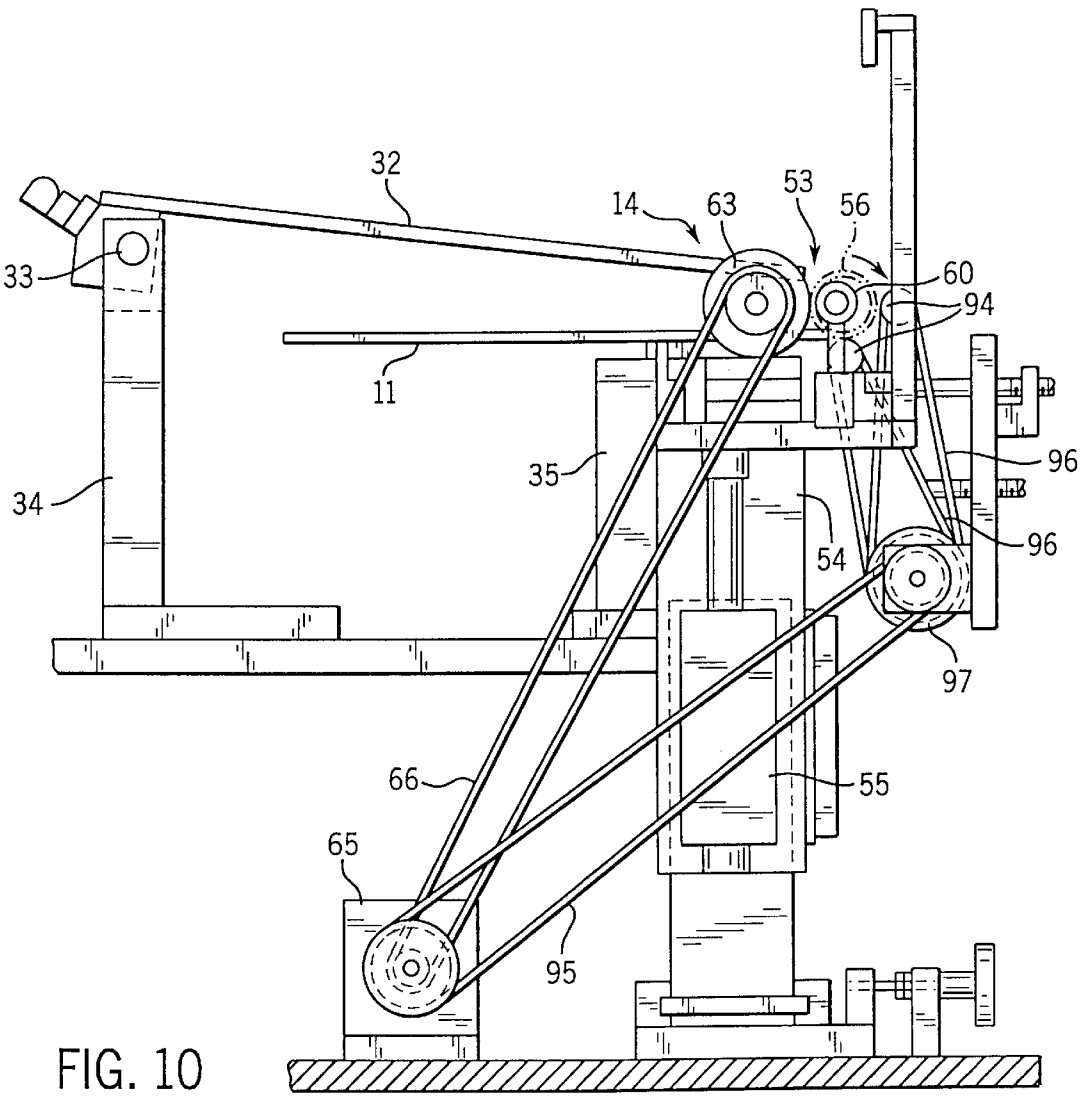
FIG. 10 is a vertical sectional view taken on line 10—10 of FIG. 9.

The trim heads 68 utilize generally conventional construction and operation to trim the coil ends and simultaneously crimp them to provide an offset end which serves to inhibit unintentional withdrawal of the coil from the holes in the edge of the book (see FIG. 19). Thus, each trim head 68 includes jaws 77 which capture the coil ends as the linear actuator 76 is retracted to bring the trim station into operative position (FIG. 15) after rotational indexing of the support plate 11. With the opposite ends of the coil 56 received in the jaws 77 of the respective trim heads 68, each trim head is operated by a small air cylinder 78 through a linkage which causes the jaws to simultaneously close and shear the coil end, while tuning and crimping it. After trimming, the linear actuator 76 (which conveniently may comprise an air cylinder) is extended to tilt the trim station out of the way to allow the support plate and fully bound book to be rotationally indexed to the discharge station 16.

Figure 17:
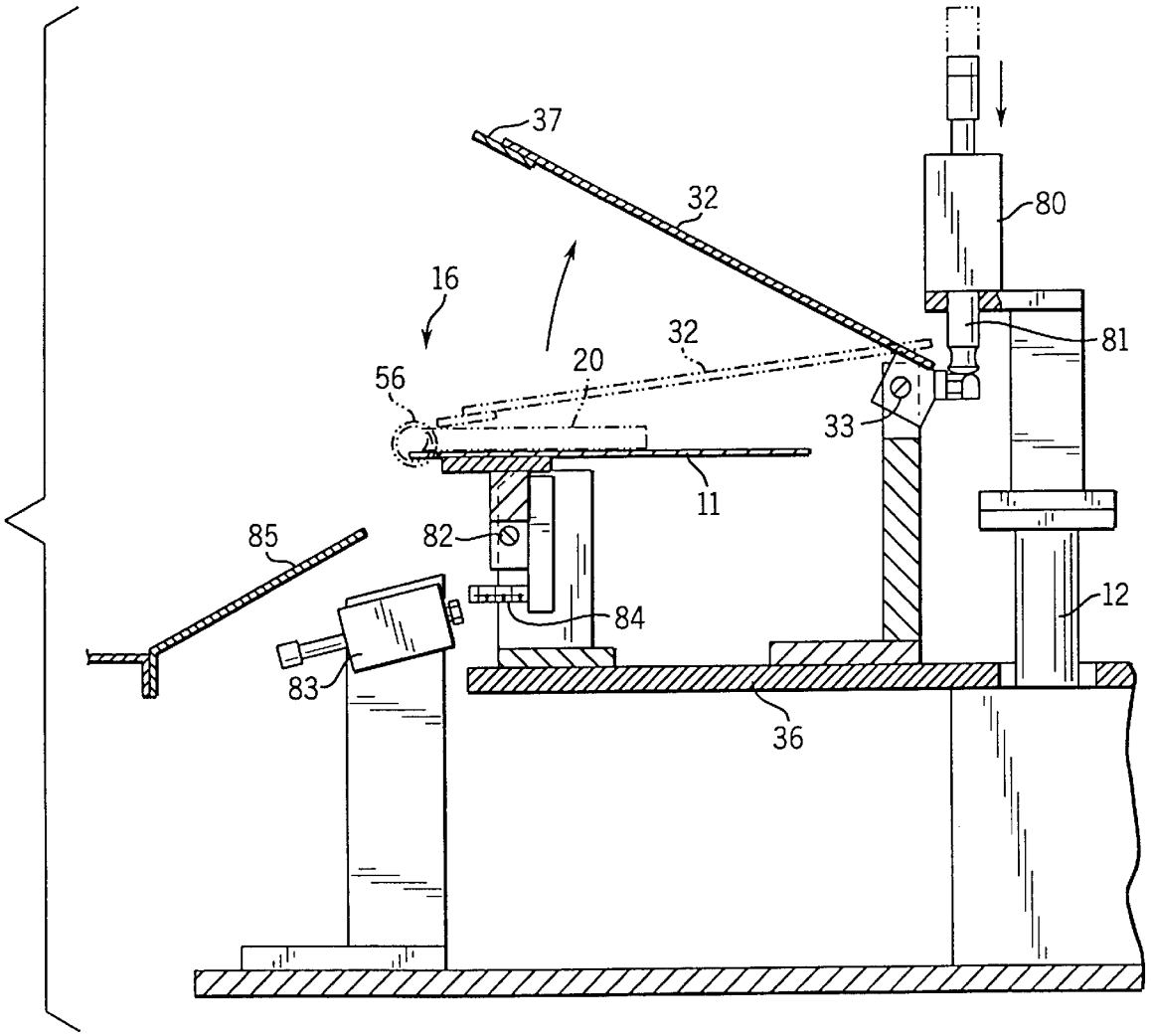
FIG. 17 is a vertical sectional view through the discharge station taken on line 17—17 of FIG. 1.
Figure 18:
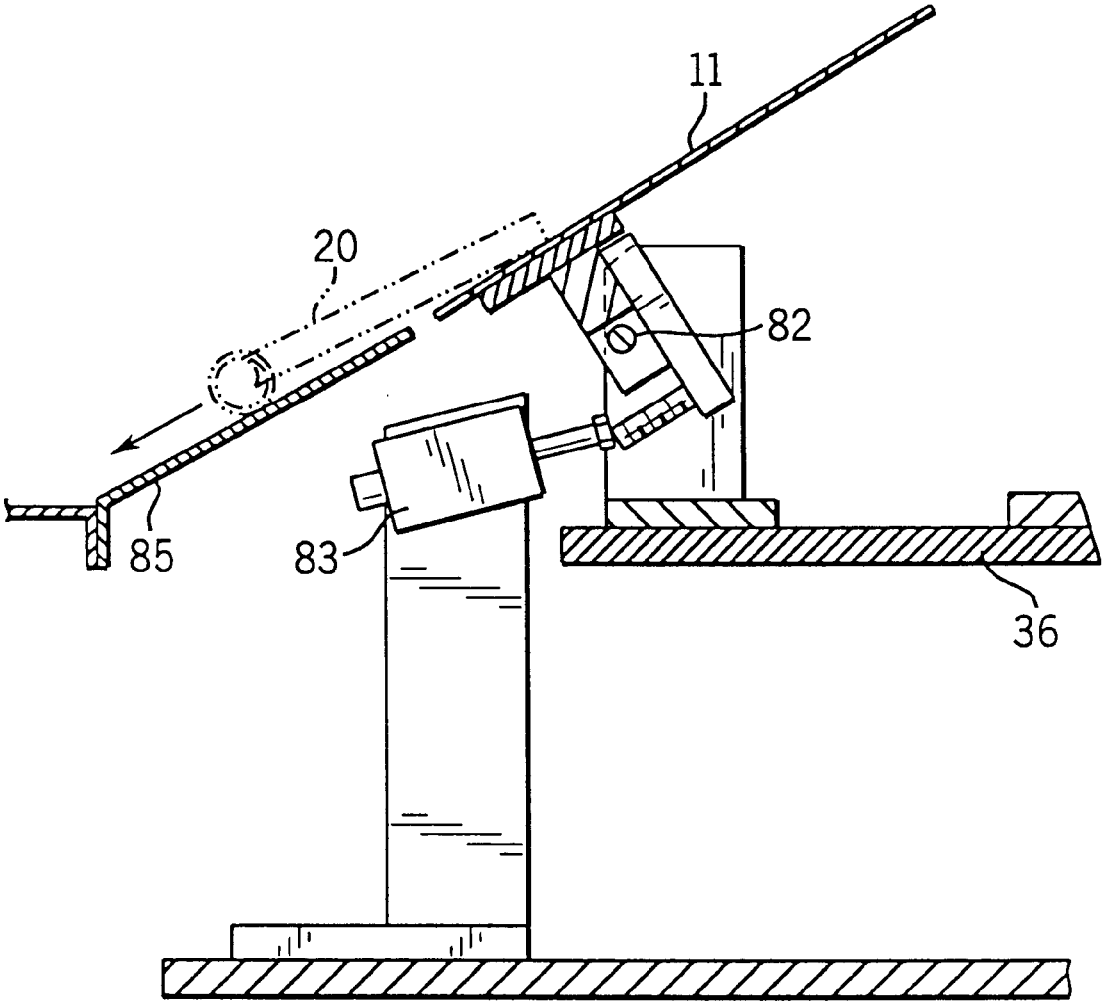
FIG. 18 is similar to FIG. 17 and shows rotation of the book support during discharge of the book.

In the discharge station 16, a vertical air cylinder 80 (identical to air cylinder 39 in the load station 13) is actuated to move the rod end 81 vertically downward against the pivot contact surface 40 of the holddown plate 32, causing the same to pivot upwardly out of contact with the book 20 (as shown in FIG. 17). The book support plate 11 is then pivoted about a horizontal pivot 82 by the extension of an air cylinder 83 mounted at a slight incline and bearing against the lower end of a pivot bracket 84. The support plate 11 is tilted into coplanar alignment with a stationary slide plate 85 onto which the spirally bound book slides by gravity (as shown in FIG. 18). Retraction of the air cylinder 83 allows the now empty support plate 11 to pivot back to its operative horizontal position for rotational indexing back to the load station 13.

Referring again to FIG. 1, the machine 10 of the present invention includes four support plate mechanisms such that a book 20 is being processed in each station 13–16 simultaneously. Once the operator positions a fresh book on the hooks 27 and lays the book on the support plate in the load station 13, the remaining processing of the book all the way to discharge is accomplished fully automatically. The machine can handle spiral coils ranging in diameter from 8 mm (about 0.3") to 50 mm (about 2") and corresponding book thicknesses. However, to accommodate the change in coil pitch with the change in coil diameter, the toothed combs 18 and the semicircular hooks 27 must also be changed. The combs 18 are made for easily demountable attachment to the edge of the support plate 11, and the hooks 27 are also readily demountably attached to the horizontal mounting bar 26.

To accommodate changes in diameter of the hooks 27, the pivot arm mechanism 24 is mounted between two pivot plates 86 each of which is pivotally attached to the upper end of one of the vertical pivot arm frame members 25 with horizontally disposed and axially aligned pivot pins 87. A spring biased locking pin 88 may be inserted through either of two positioning holes 90 in the frame member 25 and the pivot plates 86 rotationally adjusted to accommodate the diameter of the semicircular hooks 27, by selecting one of a pattern of adjustment holes 91 in the pivot plate to align with the selected positioning hole and through both of which the locking pin 88 extends. To facilitate adjustment, a guide pin 92 in the upper end of each vertical frame member 25 travels in an arcuate slot 93 in the corresponding pivot plate 86.

We claim:

1. An apparatus for inserting a spiral binding coil into an edge a book of sheets which edge has been provided with a series of equally spaced through holes on a line parallel to the edge, said apparatus comprising:

a load station including a generally horizontal book support, a pair of semicircular hooks adapted to be received in a spaced pair of said through holes to provide an initial semicircular and pitched orientation for the series of holes, and means for withdrawing said hooks, including a rotatable pivot arm mounting said hooks for rotation on an axis generally coincident with the semicircular orientation of the series of holes, and means for simultaneously rotating said pivot arm and moving said arm axially to cause said hooks to be withdrawn from the holes on a path substantially coincident with said semicircular and pitched orientation; and, a coil insertion station including means for rotatably feeding the spiral coil along an arbor positioned adjacent one end of the book edge and aligned generally axially with said semicircular orientation of the through holes to cause a lead end of the coil to sequentially pass upwardly into and through the holes and along the edge.

2. The apparatus as set forth in claim 1 wherein said hooks define a circle having a diameter approximately equal to the diameter of said coil and are mounted to lie in a plane disposed generally on a selected pitch angle of said coil.

3. The apparatus as set forth in claim 1 wherein:

said rotatable pivot arm assembly comprises a hook mounting bar extending parallel to and radially offset from rotationally axis; and, a pair of crank arms each attached at one end to an end of said mounting bar and having opposite ends journaled for rotational and axial movement on said axis; and, said means for rotating and axially moving said arm comprises a lead screw for one of said journaled ends.

4. The apparatus as set forth in claim 1 wherein said book support has a toothed edge underlying the edge of the book, adjacent teeth on said toothed edge defining spaces aligned with the holes in said book edge.

5. The apparatus as set forth in claim 4 wherein adjacent teeth have opposed edges and the edges of said teeth defining the spaces are provided with lead-in chamfers.

6. The apparatus as set forth in claim 1 wherein said arbor includes, a cylindrical body and a plurality of coil guide pins extending radially downwardly from said body and aligned in equally spaced relation in an upstream direction from the downstream end of the arbor body, said pins being spaced at approximately the spacing of the through holes.

7. The apparatus as set forth in claim 1 including means for releasably holding the book on the book support in said initial orientation.

8. The apparatus as set forth in claim 7 wherein said holding means comprises a pivotable holddown plate adapted to rest on an upper face of the book in the load station and the insertion station.

9. A method for inserting a spiral binding coil of a selected diameter and pitch angle into the edge of a book of sheets which edge has been provided with a series of equally spaced through holes on a line parallel to the edge, said method comprising the steps of:

(1) supporting the book horizontally on a support;

(2) placing a pair of through holes of the book on a pair of spaced semicircular hooks positioned on a common axis and approximately at said pitch angle to align the edge of the book to provide a semicircular concave shape with a diameter corresponding approximately to the coil diameter and to incline the holes in a direction along the edge at an angle approximately equal to the pitch angle of the coil;

(3) holding the alignment of the edge;

(4) rotating said hooks generally on their common axis and on a spiral path, conforming to said spiral coil to withdraw the hooks from the holes; and, (5) feeding the coil rotationally along its axis to cause a lead end of the coil to sequentially pass upwardly into and through the holes and along the edge.

10. The apparatus as set forth in claim 9 including the step of confining the coil against radial expansion during the feeding step.

11. The method as set forth in claim 10 wherein the confining step comprises contacting coil convolutions with a pair of guide rollers extending along and in parallel spaced relation to the coil axis.

12. The method as set forth in claim 11 wherein said guide rollers are driven.

13. An apparatus for inserting a spiral binding coil into an edge of a book of sheets which edge has been provided with a series of equally spaced through holes on a line parallel to the edge, said apparatus comprising:

a load station including a generally horizontal book support, a pair of semicircular hooks adapted to be received in a spaced pair of said through holes to provide an initial semicircular and pitched orientation for the series of holes, and means for withdrawing said hooks;

a coil insertion station including means for rotatably feeding the spiral coil along an arbor positioned adjacent one end of the book edge and aligned generally axially with said semicircular orientation of the through holes to cause a lead end of the coil to sequentially pass upwardly into and through the holes and along the edge; and, said coil insertion station including a pair of guide rollers having generally cylindrical surfaces extending along and in spaced parallel relation to the edge of the book on said book support, said rollers positioned to normally maintain the roller surfaces out of contact with the coil being rotatably inserted into the holes in the book edge, and means for driving said rollers in the same direction as coil movement to cause the roller surfaces to engage the coil convolutions and limit expansion in coil diameter during insertion.

14. The apparatus as set forth in claim 13 wherein the surface of each guide roller is provided with an axially extending flat surface.

15. An apparatus for inserting a spiral binding coil into the edge of a book of sheets which edge has been provided with a series of equally spaced through holes on a line parallel to the edge, said apparatus comprising:

a load station including a generally horizontal book support, a pair of semicircular hooks adapted to be received in a spaced pair of said through holes to provide an initial semicircular and pitched orientation for the series of holes, and means for withdrawing said hooks;

a coil insertion station including means for rotatably feeding the spiral coil along an arbor positioned adjacent one end of the book edge and aligned generally axially with said semicircular orientation of the through holes to cause the lead end of the coil to sequentially pass upwardly into and through the holes and along the edge;

a trim station having a cutting and crimping tool for each of a lead end and a trailing end of the coil, and means for moving said tools into operative engagement with said coil ends;

a discharge station including means for pivoting the book support on a generally horizontal axis to discharge the book; and, said book support mounted to rotate on a vertical axis consecutively between said load, insertion, trim and discharge stations.

16. The apparatus as set forth in claim 15 including a pivotable holddown plate adapted to rest on an upper face of the book in the load, insertion, trim and discharge stations.

* * * * *

UNITED STATES PATENT AND TRADEMARK OFFICE

CERTIFICATE OF CORRECTION

PATENT NO. : 6,056,495

DATED : May 2, 2000

INVENTOR(S) : Thomas J. Doyle and Gerald E. Blaha

It is certified that error appears in the above-indentified patent and that said Letters Patent is hereby corrected as shown below:

Column 8, Claim 2, line 12, delete "the" and substitute therefor --a selected--.

Signed and Sealed this

First Day of May, 2001

*Attest:*

Nicholas P. Godici

NICHOLAS P. GODICI

*Attesting Officer*

*Acting Director of the United States Patent and Trademark Office*